United States Patent [19]

Price

[11] 4,316,489

[45] Feb. 23, 1982

[54] METHOD AND DEVICE FOR ELIMINATING AIR FROM WATER BED MATTRESSES

[75] Inventor: William A. Price, Salt Lake City, Utah

[73] Assignee: Anthony J. Bova, Stockton, Calif.

[21] Appl. No.: 166,318

[22] Filed: Jul. 7, 1980

[51] Int. Cl.[3] ..... B65B 3/04

[52] U.S. Cl. ..... 141/1; 141/65

[58] Field of Search ..... 141/1, 301, 2–12, 141/285–310, 346–362, 37–66; 5/368, 361 R, 369, 370, 371, 1

[56] References Cited

U.S. PATENT DOCUMENTS 2,495,905 1/1950 Pogue ..... 141/301

4,094,346 6/1978 Milo ..... 141/301

*Primary Examiner*—Houston S. Bell, Jr.

*Attorney, Agent, or Firm*—Mallinckrodt & Mallinckrodt

[57] ABSTRACT

A check valve device adapted to be fitted into the filling spout of a water bed mattress in a fluid-tight manner either before or after filling of the mattress with water, so that, when the mattress is manipulated in the usual manner after filling or after gas has formed during a period of use, the air or other gas will escape substantially without loss of water. Thereupon the device is removed and the filling spout of the mattress plugged and capped in the usual manner.

11 Claims, 6 Drawing Figures

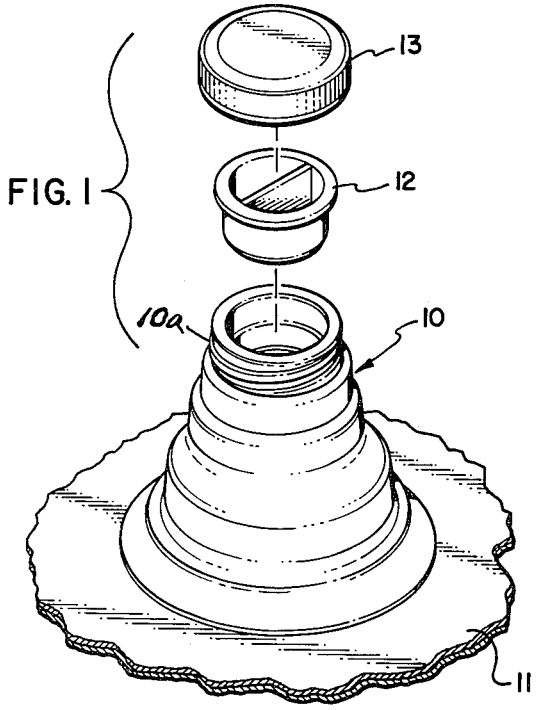
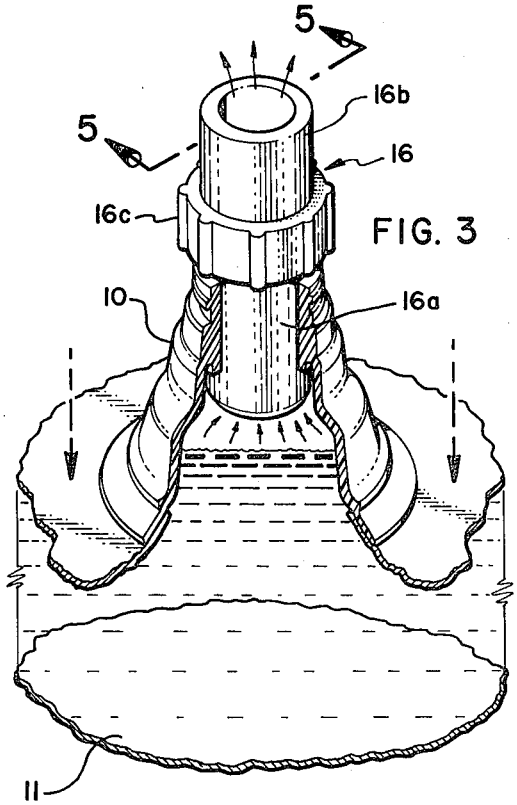
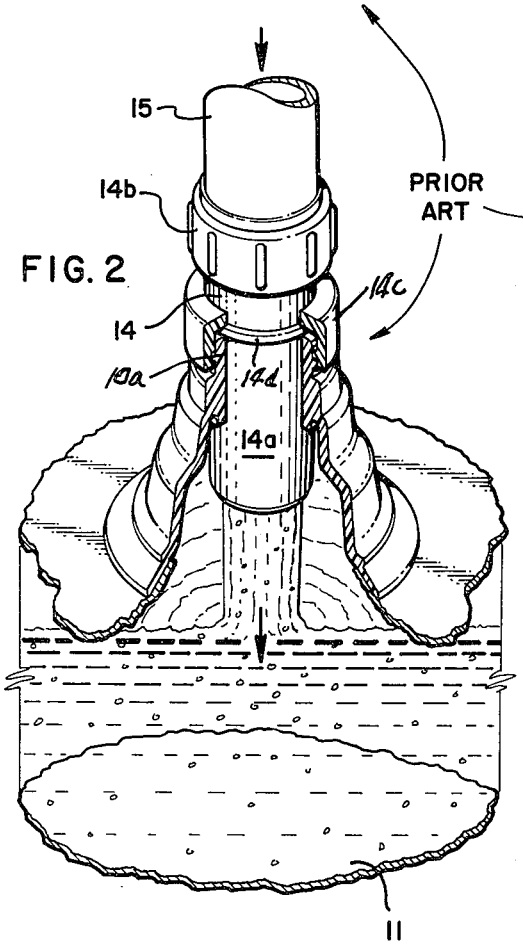
PRIOR ART
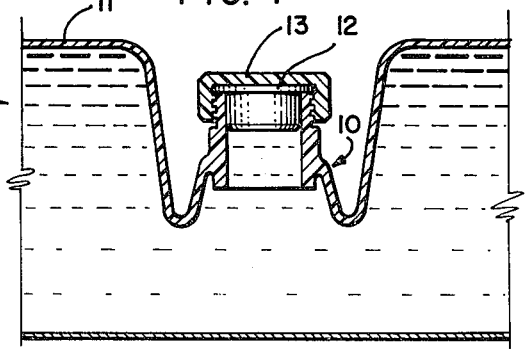
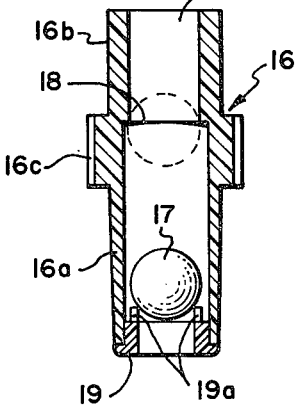
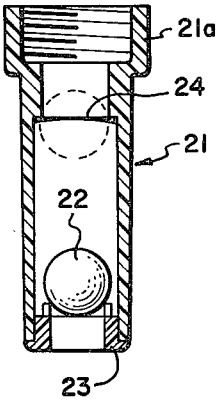

METHOD AND DEVICE FOR ELIMINATING AIR FROM WATER BED MATTRESSES

BACKGROUND OF THE INVENTION

1. Field

The invention is concerned with water bed mattresses and provides both a method and a device for eliminating entrained air and in-situ-generated gas from the water in such mattresses.

2. State of the Art

A water bed mattress is customarily provided with a filling spout through which water is introduced into the mattress and air entrained in the water as bubbles is removed from the mattress immediately after filling. The spout is plugged and capped after the filling and air removal operations, but, after the water has remained in the mattress for some time, gas is generated by algae or other organic matter in the water and must be eliminated in the same way the air bubbles were removed after the filling operation.

Filling of the water bed mattress with water is conveniently accomplished by use of a commercially available filler tube of a rigid plastic material, which tube has a lower end portion tapered for frictionally fitting into the filling spout of the mattress in a fluid-tight manner and has an upper end portion formed as a connector for a water hose.

After the filling operation is completed, the filler tube is removed, and the mattress is manipulated to work air bubbles toward the spout for elimination therethrough. The plug and cap are replaced following elimination of the air.

SUMMARY OF THE INVENTION

In accordance with the invention, a tube advantageously similar to the commercial filler tube and whether or not provided with a water hose connection at its upper end, so as to be used as a filler tube, is formed with a check valve interiorly thereof between its open lower and open upper ends. The check valve preferably comprises a ball of a type which will be raised by water but not by air or other gas rising in the tube. It is positioned for free movement between an upper ball seat provided within the tube and a lower, fluid-passing, ball retainer also provided within the tube.

The method of the invention involves the removal of the usual sealing plug and closure cap from the filling spout of the water bed mattress, the fitting of the lower end portion of the device of the invention in the filling spout fluid tight, and, if the mattress is already filled with water, the manipulating of the mattress to move air or other gas entrained in the water toward the filling spout and through the check valve, the removing of the device of the invention from the filling spout, and the replacing of the plug and cap on the filling spout. If the mattress is not already filled with water, the usual commercial filler tube may be employed for the purpose immediately prior to insertion of the device of the invention into the filling spout, or the form of the device of the invention which includes a water hose connection may be used, first, for filling the mattress with water, and, then, for eliminating air entrained as bubbles in the water.

THE DRAWINGS

In the drawings, which illustrate the best mode presently contemplated of carrying out the invention in actual practice:

FIG. 1 is a fragmentary, exploded, pictorial view of a portion of a water bed mattress which includes the usual filling spout, such spout being conventional and shown with sealing plug and closure cap removed in preparation for filling in the usual manner;

FIG. 2, a similar view showing the filling spout with conventional filler tube fitted therein and water hose connected and filling the mattress with water, a part of the filling spout and mattress in the foreground being broken away;

FIG. 3, a view similar to that of FIG. 2 but showing an embodiment of the device of the invention replacing the usual filler tube;

FIG. 4, an axial vertical section through the replugged and recapped filling spout of the water bed mattress after air has been eliminated in accordance with the invention, the mattress being in its usual condition for use;

FIG. 5, an axial vertical section through the device of the invention as shown in FIG. 3, the device being shown per se; and FIG. 6, a view corresponding to that of FIG. 5 but showing an embodiment of the device of the invention equipped for filling the mattress with water as well as for eliminating air or other gas therefrom.

DETAILED DESCRIPTION OF THE ILLUSTRATED EMBODIMENTS

The filling spout 10 of a water bed mattress 11 is shown in FIG. 1 with the usual sealing plug 12 and closure cap 13 removed ready for insertion thereinto of a filler tube 14, FIG. 2, of a type which is often used for the purpose. Such filler tube 14 is molded to shape from a substantially rigid plastic material to provide a lower portion **14*a* which is inserted into the filling spout 10 of the mattress. The upper end 14*b* is formed as a connection fitting for a water hose 15, and a captive cap 14*c* swivels on a retainer ring 14*d* so it can screw onto the upper threaded end 10*a* of filling spout 10** to hold the tube in place during filling.

After the water bed mattress 11 is filled with water, for example as shown in FIG. 2, and the usual filler tube 14 is removed from the filling spout 10, air entrained in the water as bubbles and any free air superficially of the water in the mattress is eliminated by fitting into the filling spout 10 the device of the invention shown per se in FIG. 5. This comprises an open-ended tube 16 having a cylindrical lower end portion **16*a* which is tapered downwardly for frictionally fitting into filling spout 10 of the mattress, fluid tight, as is the lower end 14*a* of filler tube 14. The upper end portion 16*b* of tube 16 and ribbed or knurled intermediate portion 16*c* are adapted to be grasped by the user for inserting the device in and removing it from filling spout 10. They project from the filling spout after insertion of lower end portion 16*a* in such filling spout as shown in FIG. 3**.

Within the tube 16 is a check valve provided by a ball 17, FIG. 5, freely movable between an upper ball seat 18 and a lower, fluid-passing, ball retainer 19, the latter being provided in this instance by a tube section formed separately from the tube proper and fitted into the open lower end of tube portion **16*a* to provide the lower end of the tube. Ball retainer 19 is provided with an annular series of mutually spaced, short, post members 19***a*, which receive and support ball 17 when it is at rest, as in FIG. 5, and which permit the passage of water or air through the spaces between such members.

For eliminating air from the mattress at such time after the filling operation as entrained bubbles have risen and joined together to form one or more large bodies of air superficially of the water in the mattress, ordinarily within an hour or so, or for eliminating gas generated in situ during use of the mattress, the mattress is manipulated as by moving a broom handle or the like under pressure across the surface thereof toward the filling spout 10 to move the air toward the filling spout and into and through the tube 16 to atmosphere.

Air or other gas passes through the spaces between members 19*a*, around ball 17 substantially without disturbing it, upwardly through tube 16, and out to atmosphere through open upper end 20 of the check valve device of the invention.

Ball 17 is of a type that will not be lifted by escaping air or gas, but will be lifted by water which may tend to escape also. As such, it may be a solid ball of a polyethylene plastic material, such as Type 955 produced by Dow Chemical Co. If lifted by water surging into tube 16, ball 17 will be carried upwardly with the water and will seat firmly against its seat 18, thereby sealing against escape of the water.

After the air or other gas is eliminated from the mattress, the check valve device 16 of the invention is removed from filling spout 10 of the mattress by grasping the ribbed or knurled member 16*c* and upper end 16*b* thereof and pulling upwardly while twisting tube 16 slightly in the filling spout. Thereafter, plug 12 is reinserted in the open end of filling spout 10 and cap 13 is screwed tightly thereover in conventional manner.

If it is desired to utilize the check valve device of the invention as a filler tube as well as to eliminate air from the mattress after filling it with water, such device, see 21, FIG. 6, is formed with a connection fitting 21*a* at its upper end for a water hose. This fitting 21*a* may be ribbed or knurled if desired to serve the purpose of member 16*c* and the latter eliminated as indicated in FIG. 6. Otherwise, the device is the same as shown in FIG. 5, having a check valve ball 22, a ball retainer section 23, and an upper ball seal 24.

Both embodiments of the device are advantageously molded entirely from the same type of substantially rigid plastic material as are the balls 17 and 22, namely the polyethylene plastic previously indicated.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A method of eliminating air or other gas from a water bed mattress equipped with a plugged and capped filling spout, comprising removing the plug and cap from the filling spout of such a mattress; fitting a check valve device fluid-tight into the filling spout; moving air or other gas toward the filling spout by manipulating the mattress while it is filled with water, thereby releasing the air or other gas to atmosphere through the check valve; removing the check valve device from the filling spout; and re-plugging and re-capping the filling spout.

2. A method according to claim 1, wherein the mattress is already filled with water before the cap is removed.

3. A method according to claim 1, wherein the check-valve device includes a hose connection, a water hose is connected to the hose connection; and the mattress is filled with water therefrom after the check-valve device is fitted into the filling spout and before movement of the air or gas theretoward.

4. A method according to claim 1, wherein the check-valve device is frictionally fitted fluid-tight in the filling spout.

5. A device for eliminating air or other gas from a water bed mattress equipped with a capped filling spout, comprising an open-ended tube defining a single flow passage through its interior and having a tapered and substantially rigid lower end portion adapted to be fitted substantially fluid tight into the filling spout of a water bed after unplugging and uncapping of said spout, and an upper end portion adapted to remain exposed for grasping by a user while inserting the device in and removing it from said spout; and a check valve within said tube and extending across said flow passage thereof for permitting the passage of air or gas from the interior of the mattress while preventing the escape of water therefrom.

6. A device according to claim 5, wherein the lower end portion of the tube is formed as a tapered cylinder for frictionally fitting into the filling spout in a fluid tight manner.

7. A device according to claim 5, wherein the check valve is provided by a ball, by a seat for the ball positioned upwardly therefrom in the tube, and by fluid-passing retainer means for the ball spaced downwardly from said seat and upon which the ball normally rests, said ball being freely movable between said retainer means and said seat and being of a type which will be raised tightly against said seat by water rising in said tube but will remain on or near the retainer means when air or other gas is rising through said tube to escape through the open upper end thereof.

8. A device according to claim 7, wherein the lower end of the tube is a tube section separable from the remainder of the tube and provides the ball retainer means.

9. A device according to claim 8, wherein the device is formed entirely from molded plastic.

10. A device according to claim 5, wherein the open upper end of the tube is formed as a connection for a water hose.

11. In combination, the device of claim 5, and a water bed mattress filled with water and having a filling spout, the said device being tightly but removably fitted into the said filling spout for enclosing air or other gas to be released from the mattress substantially without loss of water therefrom.

* * * * *